US007344093B2

(12) United States Patent
Yamamoto et al.

(10) Patent No.: US 7,344,093 B2
(45) Date of Patent: Mar. 18, 2008

(54) FUEL INJECTION VALVE HAVING STATIONARY CORE AND MOVABLE CORE

(75) Inventors: Shinsuke Yamamoto, Kariya (JP); Masaki Akutagawa, Chiryu (JP); Koichi Sugiyama, Nagoya (JP)

(73) Assignee: Denso Corporation (JP)

( * ) Notice: Subject to any disclaimer, the term of this patent is extended or adjusted under 35 U.S.C. 154(b) by 183 days.

(21) Appl. No.: 11/018,963

(22) Filed: Dec. 22, 2004

(65) Prior Publication Data

US 2005/0140480 A1 Jun. 30, 2005

(30) Foreign Application Priority Data

Dec. 26, 2003 (JP) ..... 2003-434576
Oct. 22, 2004 (JP) ..... 2004-307837

(51) Int. Cl.
*F02M 51/00* (2006.01)

(52) U.S. Cl. ..... 239/585.1; 239/585.4

(58) Field of Classification Search ... 239/585.1–585.5
See application file for complete search history.

(56) References Cited

U.S. PATENT DOCUMENTS 4,915,350 A 4/1990 Babitska et al.
6,012,655 A 1/2000 Maier
6,364,220 B2 4/2002 Willke et al.
2003/0127544 A1* 7/2003 Demere et al. ..... 239/585.4
2004/0169095 A1* 9/2004 Cristiani et al. ..... 239/585.1

FOREIGN PATENT DOCUMENTS

JP 60-256550 12/1985
JP B2-6-56139 7/1994
JP 2002-206468 7/2002

OTHER PUBLICATIONS

Chinese Official Action issued in counterpart Chinese Application No. 2004101036914 dated Jan. 19, 2007; with English translation.

* cited by examiner

*Primary Examiner*—Ramon M. Barrera
(74) *Attorney, Agent, or Firm*—Nixon & Vanderhye PC

(57) ABSTRACT

A tubular member is arranged radially inward of a coil to cover outer peripheral parts of a movable core and of a stationary core. The stationary core has a tapered portion in an opposing portion, which is opposed to the movable core. The stationary core also has a large diameter portion on a counter movable core side of the tapered portion. An outer diameter of the tapered portion is increased from an opposing end surface side part toward the large diameter portion. The outer diameter of the opposing end surface of the opposing portion, which is opposed to the movable core, is generally the same as an outer diameter of the movable core. An outer diameter of the large diameter portion of the stationary-core is larger than the outer diameter of the movable core.

11 Claims, 10 Drawing Sheets

FUEL INJECTION VALVE HAVING STATIONARY CORE AND MOVABLE CORE

CROSS REFERENCE TO RELATED APPLICATION

This application is based on and incorporates herein by reference Japanese Patent Application No. 2003-434576 filed on Dec. 26, 2003 and Japanese Patent Application No. 2004-307837 filed on Oct. 22, 2004.

BACKGROUND OF THE INVENTION

1. Field of the Invention

The present invention relates to a fuel injection valve, which has a stationary core and a movable core.

2. Description of Related Art

For example, in a fuel injection valve 300 shown in FIG. 16, a magnetic attractive force, which attracts a movable core 304 to a stationary core 302, may be increased by increasing a cross sectional area of a magnetic path of the stationary core 302 and of the movable core 304 to increase an amount of magnetic flux, which passes between the stationary core 302 and the movable core 304. Furthermore, as recited in Japanese Unexamined Patent Publication No. 2002-206468, even in a case of a fuel injection valve, in which the stationary core and the movable core are surrounded by a magnetic pipe, the magnetic attractive force can be increased by increasing the cross sectional area of the magnetic path of the stationary core and of the movable core.

However, when the cross sectional area of the movable core is increased to increase the cross sectional area of the magnetic path, the weight of the movable core is disadvantageously increased. As a result, although the magnetic attractive force is increased, the valve opening response of the fuel injection valve could be disadvantageously reduced at the time of opening the fuel injection valve for injecting fuel.

In a case of a solenoid fuel injection valve, a portion of the magnetic flux generated by a coil does not pass between the stationary core and the movable core and thus does not contribute to generation of the magnetic attractive force. However, such a portion of the magnetic flux still passes in the movable core or in the stationary core. Normally, an axial overlapping length of the stationary core, which axially overlaps with the coil, is longer than that of the movable core. Thus, the non-contributing magnetic flux, which does not contribute to the generation of the magnetic attractive force, may be generated more in the stationary core in comparison to the movable core. Thus, in a case where the cross sectional area of the magnetic path of the stationary core is equal to that of the movable core, when the amount of magnetic flux generated by the coil is increased, the stationary core is magnetically saturated first before magnetic saturation of the movable core takes place.

With reference to FIG. 17, for example, inventors of the present invention have previously proposed to increase the outer diameter of the stationary core 312 beyond the outer diameter of the movable core 310 to increase the cross sectional area of the magnetic path and thereby to increase the amount of saturation magnetic flux. In this way, the amount of magnetic flux, which contributes to the generation of the magnetic attractive force, is increased, so that the magnetic attractive force is advantageously increased without increasing the weight of the movable core. Therefore, the valve opening response is improved.

In Japanese Unexamined Patent Publication No. 2002-206468, the cross sectional area of the magnetic path of the stationary core is increased by reducing the inner diameter of the stationary core while maintaining the outer diameter of the movable core equal to the outer diameter of the stationary core.

In the cases of FIG. 17 and of Japanese Unexamined Patent Publication No. 2002-206468, when the cross sectional area of the magnetic path of the stationary core is increased beyond the cross sectional area of the magnetic path of the movable core to increase the amount of saturation magnetic flux, the valve opening response can be improved without increasing the weight of the movable core. However, the remaining magnetic flux may be increased to reduce valve closing response.

In the case of FIG. 17 where the outer diameter of the stationary core 312 is made larger than the outer diameter of the movable core 310, when a magnetic member 314 is arranged radially outward of the movable core 310, the stationary core 312 is axially opposed to both the movable core 310 and magnetic member 314. In such a case, a portion of the magnetic flux, which flows between the movable core 310 and the stationary core 312 and contributes to the generation of the magnetic attractive force for attracting the movable core 310, flows between the stationary core 312 and the magnetic member 314, so that the magnetic flux, which flows between the stationary core and the movable core, is reduced. As a result, even when the cross sectional area of the large diameter portion of the stationary core is increased by increasing the outer diameter of the stationary core relative to that of the movable core, an increase of the magnetic attractive force is not sufficient.

SUMMARY OF THE INVENTION

The present invention addresses the above disadvantages. Thus, it is an objective of the present invention to provide a fuel injection valve, which shows good valve opening response and good valve closing response.

To achieve the objective of the present invention, there is provided a fuel injection valve, which includes a stationary core, a movable core, a valve member, a coil and a magnetic member. The movable core is opposed to the stationary core. The valve member is reciprocated together with the movable core to enable and disable injection of fuel from the fuel injection valve. The coil generates a magnetic attractive force between the stationary core and the movable core upon energization of the coil. The magnetic member is arranged radially outward of the movable core. The stationary core includes an opposing portion and a large diameter portion. The opposing portion is opposed to the movable core. The large diameter portion is arranged on a counter movable core side of the opposing portion, which is opposite from the movable core. An outer diameter of the large diameter portion is larger than an outer diameter of the movable core. A cross sectional area of a magnetic path of the large diameter portion is larger than that of an opposing part of the movable core, which is opposed to the stationary core. An opposing end surface side part of the opposing portion, which is opposed to the movable core, is radially inwardly recessed relative to the large diameter portion.

To achieve the objective of the present invention, there is also provided a fuel injection valve, which includes a stationary core, a movable core, a valve member and a coil. The movable core is opposed to the stationary core. The valve member is reciprocated together with the movable core to enable and disable injection of fuel from the fuel injection valve. The coil generates a magnetic attractive force between the stationary core and the movable core upon energization of the coil. The stationary core includes a thick wall portion and a thin wall portion. The thick wall portion is at least partially disposed radially inward of the coil. A cross sectional area of a magnetic path of the thick wall portion is larger than that of the movable core. A thin wall portion has a peripheral surface recessed relative to an adjacent peripheral surface of the thick wall portion. A cross sectional area of a magnetic path of the thin wall portion is smaller than that of the thick wall portion.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Embodiments of the present invention will be described with reference to the accompanying drawings.

(First Embodiment)

Figure 1:
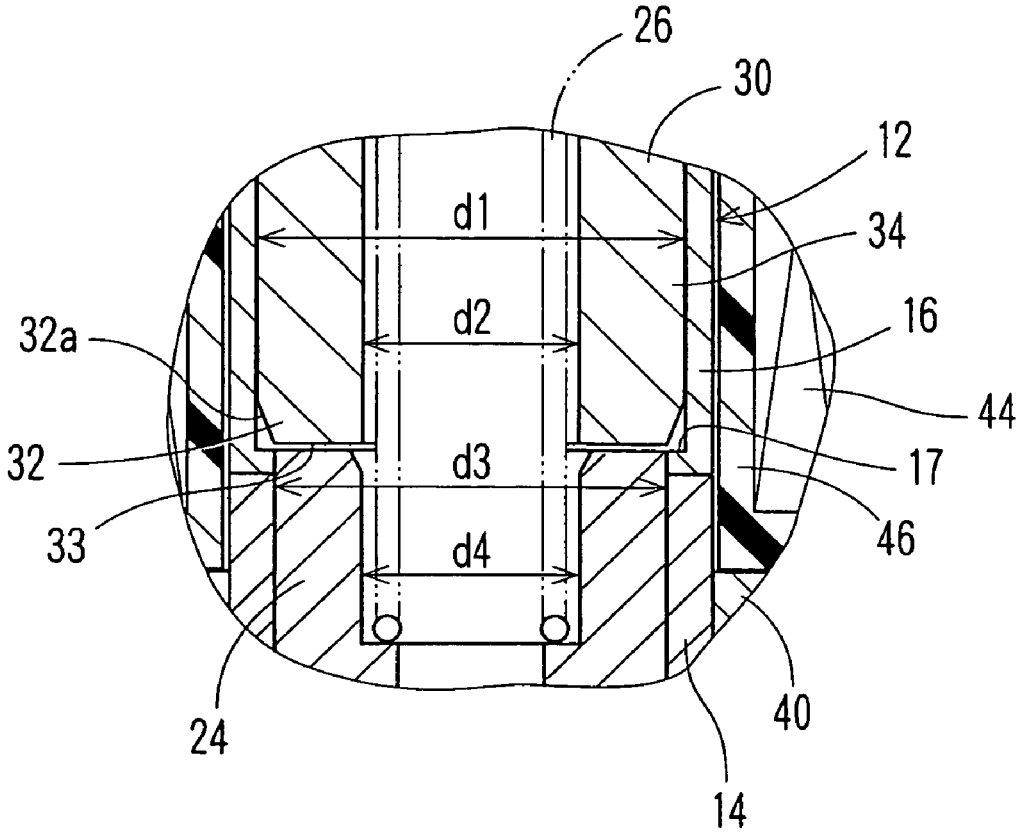
FIG. 1 is a cross sectional view showing opposed parts of a stationary core and of a movable core according to a first embodiment of the present invention.
Figure 2:
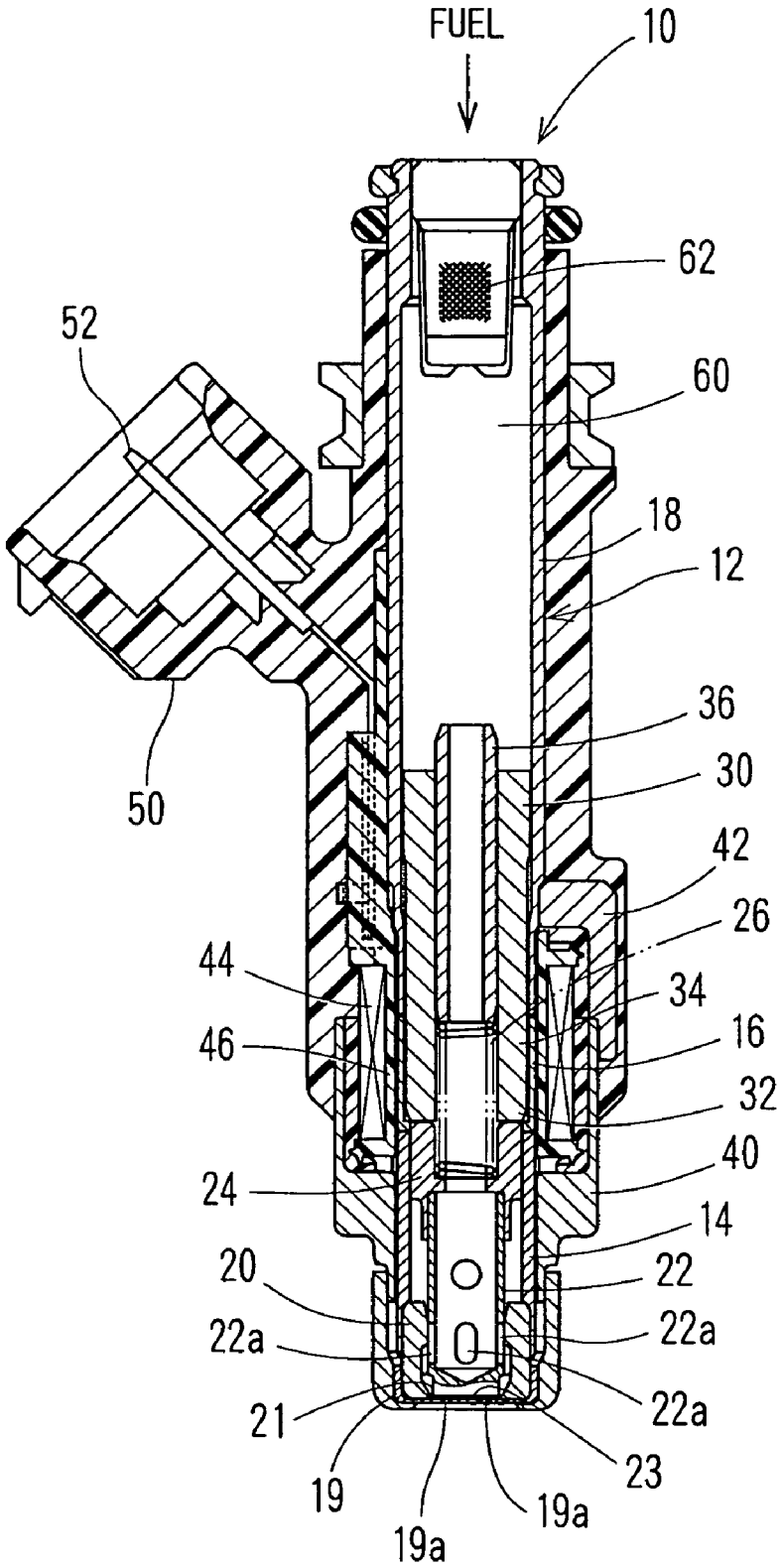
FIG. 2 is a cross sectional view of a fuel injection valve of the first embodiment.

With reference to FIGS. 1 and 2, a fuel injection valve according to a first embodiment of the present invention will be described. The fuel injection valve 10 is designed as a fuel injection valve for a gasoline engine. A tubular member 12 is formed into a cylindrical body, which is made of magnetic members and a non-magnetic member. A fuel passage 60 is formed in the tubular member 12. A valve body 20, a valve member 22, a movable core 24, a spring (serving as an urging member) 26 and a stationary core 30 are received in the fuel passage 60.

The tubular member 12 includes a first magnetic member 14, a non-magnetic member (serving as a magnetic resistive member) 16, a second magnetic member 18, which are arranged in this order from a valve body 20 side end of the tubular member 12 in FIG. 2. The tubular member 12 is arranged radially inward of a coil 44 and covers an outer peripheral part of the movable core 24 and an outer peripheral part of the stationary core 30. The first magnetic member 14 serves as a magnetic member recited in the claims. The magnetic member 14 is arranged radially outward of the movable core 24 and covers the outer peripheral part of the movable core 24. The first magnetic member 14 and the non-magnetic member 16 are joined together by welding. Also, the non-magnetic member 16 and the second magnetic member 18 are joined together by welding. The welding is performed through, for example, a laser welding process. The first magnetic member 14 and the second magnetic member 18 of the tubular member 12 form a magnetic circuit in corporation with the movable core 24 and the stationary core 30. The non-magnetic member 16 prevents short-circuiting of the magnetic flux between the first magnetic member 14 and the second magnetic member 18. A step 17 (FIG. 1) is formed in an inner peripheral part of the non-magnetic member 16 at a first magnetic member 14 side end of the non-magnetic member 16 in conformity with an outer diameter difference between the movable core 24 and the stationary core 30. The wall thickness of the first magnetic member 14 is made larger than that of the non-magnetic member 16 in conformity with the step 17. A fuel filter 62 is received in a fuel inlet side end of the tubular member 12.

The valve body 20 is securely welded to an inner peripheral part of an injection hole side end of the first magnetic member 14. An inner peripheral wall of the valve body 20 includes a valve seat 21, against which the valve member 22 is seatable. A cup-shaped injection hole plate 19 is securely welded to an outer peripheral wall of the valve body 20. The injection hole plate 19 is shaped into a thin plate form and has a plurality of injection holes 19*a* in a center region of the injection hole plate 19.

The valve member 22 is shaped into a hollow cup-shaped body and has an engaging portion 23 in a bottom of the valve member 22. The engaging portion 23 is seatable against the valve seat 21, which is formed in the valve body 20. When the engaging portion 23 is seated against the valve seat 21, the injection holes 19*a* are closed to stop fuel injection. A plurality of fuel holes 22*a* is formed to penetrate through a peripheral wall of the valve member 22 on an upstream side of the engaging portion 23. The fuel, which is supplied into the valve member 22, passes outwardly through the fuel holes 22*a* and flows toward a valve part, which is formed by the engaging portion 23 and the valve seat 21.

The movable core 24 is secured by, for example, welding to a counter valve body side end of the valve member 22, which is opposite from the valve body 20. The spring (serving as the urging member) 26 urges the movable core 24 and the valve member 22 in a direction that causes seating of the valve member 22 against the valve seat 21.

The stationary core 30 is shaped into a cylindrical body and is received in the tubular member 12. The stationary core 30 is arranged on a counter valve body side of the movable core 24, which is opposite from the valve body 20, and the stationary core 30 is opposed to the movable core 24. The stationary core 30 has a tapered portion (serving as an opposing portion) 32 on an opposing side thereof that is opposed to the movable core 24. Furthermore, the stationary core 30 has a large diameter portion 34 on a counter movable core side of the tapered portion 32, which is opposite from the movable core 24. As shown in FIG. 1, a surface area of an opposing end surface 33 of the tapered portion 32, which is opposed to the movable core 24, i.e., the surface area of the opposing end surface 33 of the stationary core 30, which is opposed to the movable core 24, is generally equal to a cross sectional area of a magnetic path of the opposing part of the movable core 24, at which the movable core 24 is opposed to the stationary core 30. The tapered portion 32 includes a slant surface 32*a*, which has an increasing outer diameter that increases from the opposing end surface 33 toward the large diameter portion 34 provided on the counter movable core side of the tapered portion 32, which is opposite from the movable core. The outer diameter of the opposing end surface 33, which is opposed to the movable core 24, is generally the same as the outer diameter of the movable core 24.

The inner diameter d2 of the stationary core 30 is generally the same as the inner diameter d4 of the movable core 24. The outer diameter d1 of the large diameter portion 34 of the stationary core 30 is larger than the outer diameter d3 of the movable core 24. Here, the cross sectional area Sc of the magnetic path of the large diameter portion 34 of the stationary core 30 is defined as $Sc=\pi(d1^2-d2^2)/4$. Furthermore, the cross sectional area Sn of the magnetic path of the opposing part of the movable core 24 is defined as $Sn=\pi(d3^2-d4^2)/4$. Because of d1>d3 and d2=d4, Sc>Sn is satisfied. More specifically, the cross sectional area of the magnetic path of the opposing end surface 33 side part of the tapered portion 32, at which the stationary core 30 is opposed to the movable core 24, is smaller than that of the large diameter portion 34, and the cross sectional area of the magnetic path of the large diameter portion 34 is larger than the cross sectional area of the magnetic path of the opposing part of the movable core 24, which is opposed to the stationary core 30. Here, the opposing end surface 33 side part of the tapered portion 32 is defined as the movable core 24 side end of the tapered portion 32 and thus includes the end surface 33.

An adjusting pipe 36 shown in FIG. 2 is press fitted into the stationary core 30. One end of the spring 26 is engaged with the adjusting pipe 36. The urging force of the spring 26 is adjusted by adjusting an amount of insertion of the adjusting pipe 36 in the stationary core 30.

Magnetic members 40, 42 are magnetically connected to one another and are arranged radially outward of the coil 44. The magnetic member 40 is magnetically connected to the first magnetic member 14, and the magnetic member 42 is magnetically connected to the second magnetic member 18. The stationary core 30, the movable core 24, the first magnetic member 14, the magnetic members 40, 42 and the second magnetic member 18 form the magnetic circuit.

A spool 46, around which the coil 44 is wound, is installed to an outer peripheral part of the tubular member 12. A resin housing 50 covers the outer peripheral part of the tubular member 12 and an outer peripheral part of the coil 44. A terminal (terminal arrangement) 52 is electrically connected to the coil 44 to supply drive electric current to the coil 44.

Fuel, which is supplied to the fuel passage 60 from a top side end of the tubular member 12 in FIG. 2, passes a fuel passage of the stationary core 30, a fuel passage of the movable core 24, a fuel passage of the valve member 22, the fuel holes 22*a* and an opening, which is defined between the engaging portion 23 and the valve seat 21 at the time of lifting the engaging portion 23 from the valve seat 21. Then, the fuel is injected through the injection holes 19*a*.

In the fuel injection valve 10, when the power supply to the coil 44 is turned off, the valve member 22 is urged by the urging force of the spring 26 to move downward in FIG. 2, i.e., the valve member 22 is moved in a valve closing direction, so that the engaging portion 23 of the valve member 22 is seated against the valve seat 21 to close the injection holes 19*a*.

When the power supply to the coil 44 is turned on, the magnetic flux passes the magnetic circuit, which is made of the stationary core 30, the movable core 24, the first magnetic member 14, the magnetic members 40, 42 and the second magnetic member 18. Therefore, the magnetic attractive force is generated between the stationary core 30 and the movable core 24. Then, the movable core 24 and the valve member 22 are moved against the urging force of the spring 26 toward the stationary core 30, so that the engaging portion 23 is lifted away from the valve seat 21. In this way, the fuel is injected through the injection holes 19*a*. The maximum amount of valve lift of the valve member 22 is set or adjusted through adjustment of the engaging point of the movable core 24 with the stationary core 30.

Next, the magnetic flux, which passes the stationary core 30, will be described.

The magnetic flux, which passes the tapered portion 32 of the stationary core 30, i.e., the opposing portion of the stationary core 30 opposed to the movable core 24, mainly passes between the tapered portion 32 and the movable core 24 and contributes to generation of the magnetic attractive force for attracting the movable core 24 toward the stationary core 30. In contrast, in the large diameter portion 34, which is the counter movable core side part of the stationary core 30, the magnetic flux does not flow between the large diameter portion 34 and the movable core 24. Thus, in the large diameter portion 34, a ratio of the non-contributing magnetic flux, which does not contribute to the generation of the magnetic attractive force, is higher than that of the tapered portion 32. Therefore, the amount of flow of magnetic flux in the large diameter portion 34 of the stationary core 30 is larger than that of the tapered portion 32. Thus, in the first embodiment, the outer diameter of the large diameter portion 34, which is the counter movable core side part of the stationary core 30, is made larger than that of the movable core 24 to increase the cross sectional area of the large diameter portion 34 in comparison to that of the opposing part of the movable core 24, which is opposed to the stationary core 30, without increasing the cross sectional area of the magnetic path of the movable core 24. In this way, the amount of magnetic flux, which passes between the movable core 24 and the stationary core 30 to contribute to the generation of the magnetic attractive force, is increased to increase the magnetic attractive force for attracting the movable core 24 toward the stationary core 30 without increasing the weight of the movable core 24. Therefore, the valve opening response is improved.

The opposing end surface 33 side part of the tapered portion 32 is radially inwardly recessed, i.e., is radially inwardly reduced, so that the cross sectional area of the opposing end surface 33 of the stationary core 30, which is opposed to the movable core 24, is reduced. Therefore, a portion of the magnetic flux, which passes between the stationary core 30 and the movable core 24, is limited from flowing between the stationary core 30 and the first magnetic member 14, which covers the outer peripheral part of the movable core 24. In this way, it is possible to limit a reduction in the amount of magnetic flux, which passes between the stationary core 30 and the movable core 24 and is increased by the provision of the large diameter portion 34. Therefore, the magnetic attractive force for attracting the movable core 24 is increased to improve the valve opening response.

Furthermore, in the tubular member 12, the step 17 is formed in conformity with the outer diameter difference between the movable core 24 and the stationary core 30, and the wall thickness of the first magnetic member 14, which covers the outer peripheral part of the movable core 24, is increased. Thus, a gap between the movable core 24 and the first magnetic member 14 is reduced, so that a reduction in the magnetic attractive force is advantageously limited.

Also, in the first embodiment, the opposing end surface 33 side part of the tapered portion 32 is radially inwardly recessed, so that the cross sectional area of the magnetic path of the opposing end surface 33 side part of the tapered portion 32 becomes smaller than that of the large diameter portion 34. As a result, the tapered portion 32 acts as a magnetic choke (magnetic throttle), so that it is possible to limit the flow of the magnetic flux between the movable core 24 and the stationary core 30 beyond the required amount, and it is possible to reduce the saturated attractive force. Therefore, the remaining magnetic flux is reduced, and thereby the valve closing response is improved.

In the first embodiment, the cross sectional area of the magnetic path of the stationary core 30 is increased by increasing the outer diameter of the stationary core 30 instead of decreasing the inner diameter of the stationary core 30. As a result, a reduction in the outer diameter of the spring 26 is prevented, and thereby an increase in the spring constant of the spring 26 is limited. In this way, a change in the urging force of the spring 26 relative to the amount of insertion of the adjusting pipe 36 is not substantially increased, so that an adjustable range of the adjusting pipe 6 for adjusting the urging force of the spring 26 is widened. As a result, the adjustment of the spring 26 is eased.

Also, in the first embodiment, the tubular member 12, which forms the magnetic circuit in corporation with the stationary core 30 and the movable core 24, covers the outer peripheral part of the stationary core 30 and the outer peripheral part of the movable core 24 and supports the stationary core 30. Variations in a gap between the movable core 24 and the stationary core 30 can be limited by adjusting the axial position of the stationary core 30 in the tubular member 12. Also, a desired fuel injection amount can be obtained by adjusting the gap between the movable core 24 and the stationary core 30 through the adjustment of the axial position of the stationary core 30 in the tubular member 12.

(Second Embodiment)

Figure 3:
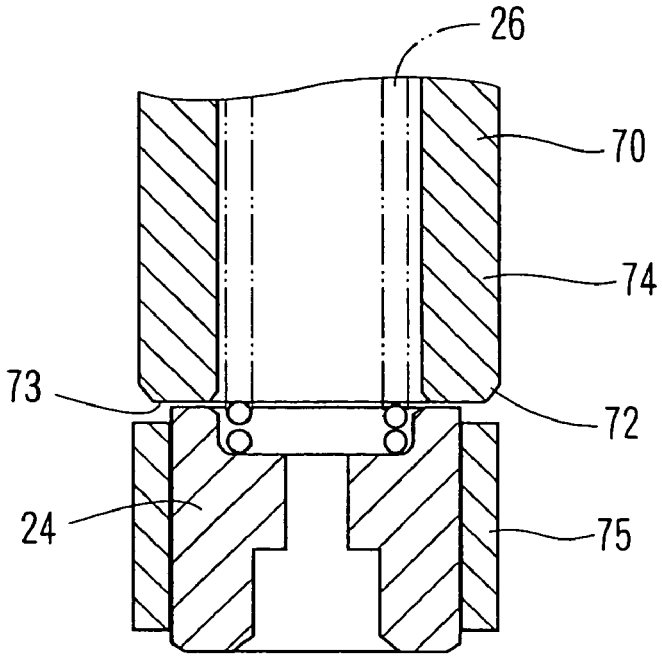
FIG. 3 is a cross sectional view showing opposed parts of a stationary core and of a movable core according to a second embodiment.

FIG. 3 shows a second embodiment of the present invention. Components similar to those of the first embodiment will be indicated by the same numerals.

In the first embodiment, the outer diameter of the opposing end surface 33 of the tapered portion (serving as the opposing portion) 32, which is opposed to the movable core 24, is set to be the same as the outer diameter of the movable core 24. Alternatively, in the second embodiment shown in FIG. 3, as long as the opposing end surface 73 side part of the tapered portion (serving as the opposing portion) 72 of the stationary core 70 is radially inwardly recessed relative to the large diameter portion 74, the outer diameter of the opposing end surface 73 of the tapered portion 72 can be made larger than the outer diameter of the movable core 24. The magnetic member 75 is formed into the cylindrical shape and covers the outer peripheral part of the movable core 24. Even in this case, the surface area of the opposing end surface 73 of the stationary core 70, which is opposed to the magnetic member 75 that covers the outer peripheral part of the movable core 24, is reduced. Therefore, it is possible to limit the portion of the magnetic flux between the stationary core 70 and the movable core 24 from flowing between the stationary core 70 and the magnetic member 75.

(First and Second Modifications)

Figure 4A:
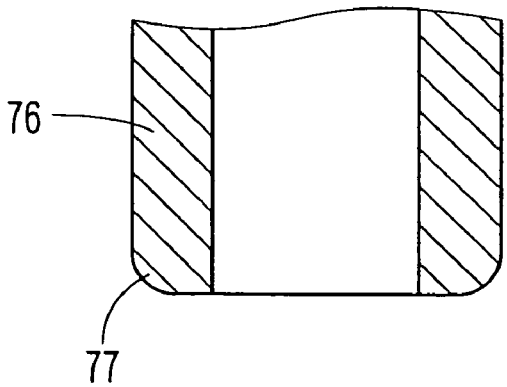
FIG. 4A is a cross sectional view showing a first modification of the stationary core of the second embodiment.
Figure 4B:
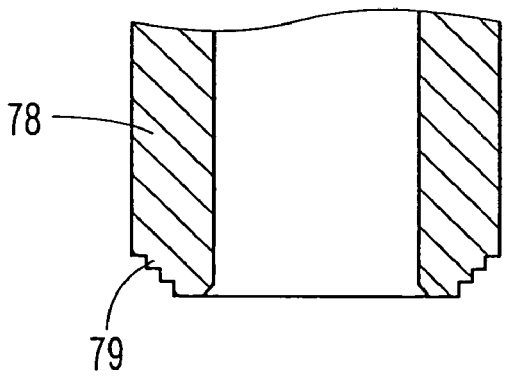
FIG. 4B is a cross sectional view showing a second modification of the stationary core.

Alternatively, as indicated in FIG. 4A, which shows a first modification of the second embodiment, the opposing portion 77 of the stationary core 76 can be formed into a convexly curved shape. Further alternatively, as indicated in FIG. 4B, which shows a second modification of the second embodiment, the opposing portion 79 of the stationary core 78 can be formed into a stair-like shape.

(Third Embodiment)

Figure 5:
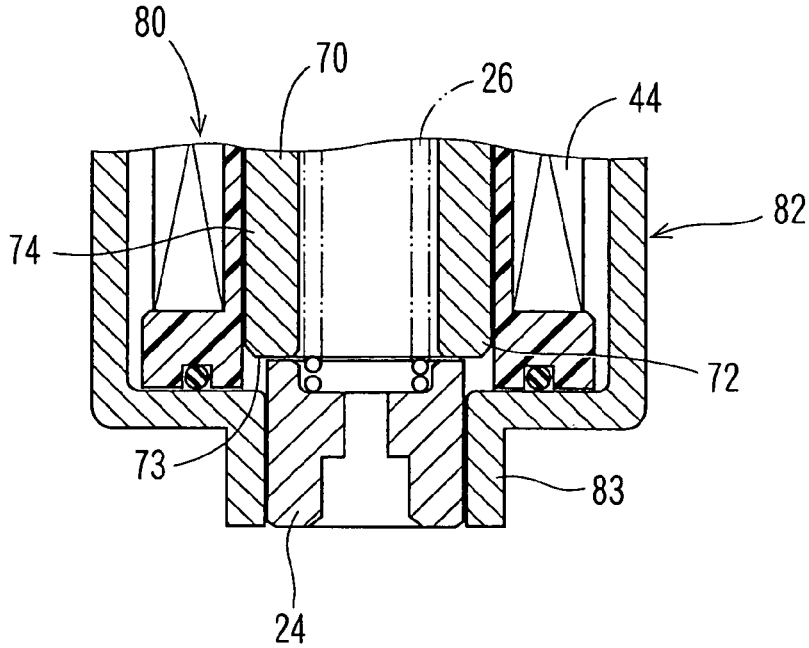
FIG. 5 is a cross sectional view showing opposed parts of a stationary core and of a movable core according to a third embodiment.

FIG. 5 shows a third embodiment of the present invention. Components similar to those of the first embodiment will be indicated by the same numerals.

In the fuel injection valve 80 of the third embodiment, the tubular member, which covers the outer peripheral part of the movable core 24 and the outer peripheral part of the stationary core 70, is not arranged radially inward of the coil 44. An end portion 83 of the magnetic member 82, which covers the outer peripheral part of the coil 44, also covers the outer peripheral part of the movable core 24 and is axially opposed to the stationary core 70. The end portion 83 of the magnetic member 82 serves as the magnetic member recited in the claims. Even with this structure, the opposing end surface 73 side part of the tapered portion 72 of the stationary core 70 is radially inwardly recessed. Thus, a portion of the magnetic flux, which passes between the movable core 24 and the stationary core 70, is limited from flowing between the stationary core 70 and the end portion 83. Therefore, the magnetic attractive force for attracting the movable core 24 to the stationary core 70 is increased to improve the valve opening response.

(Fourth to Sixth Embodiments)

Figure 6:
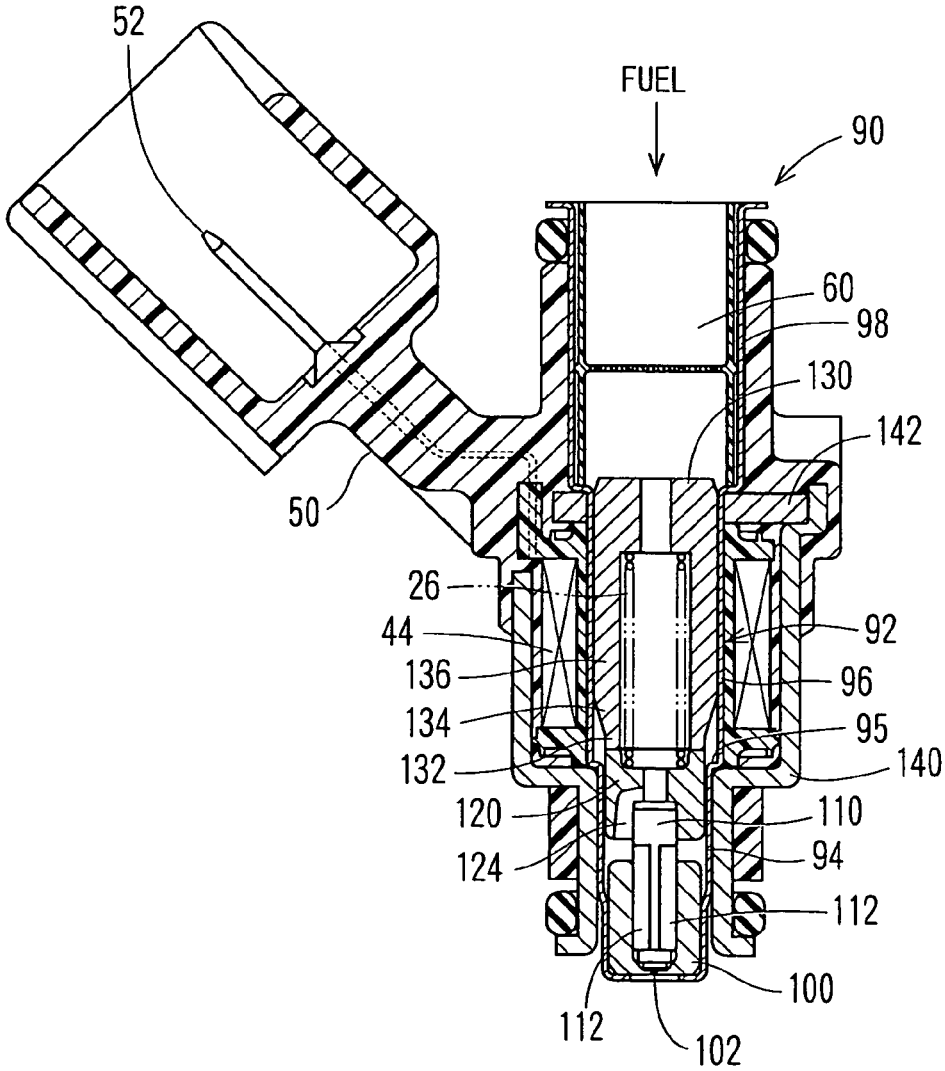
FIG. 6 is a cross sectional view of a fuel injection valve of a fourth embodiment.
Figure 7:
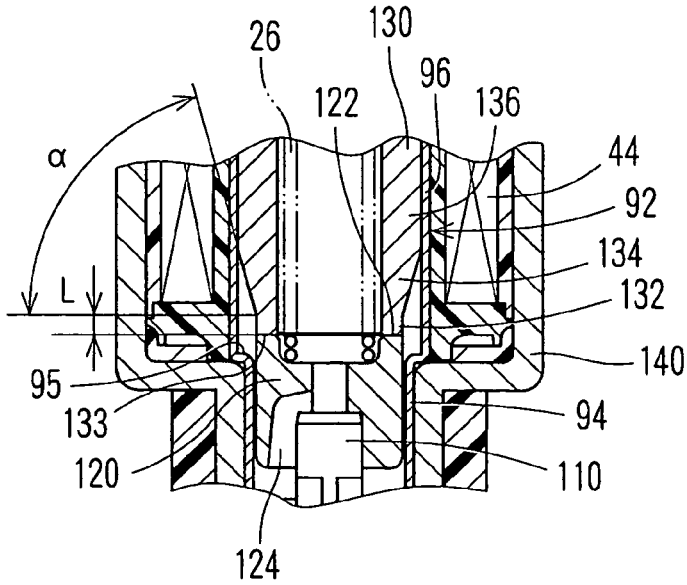
FIG. 7 is a cross sectional view showing opposed parts of a stationary core and of a movable core according to the fourth embodiment.
Figure 8A:
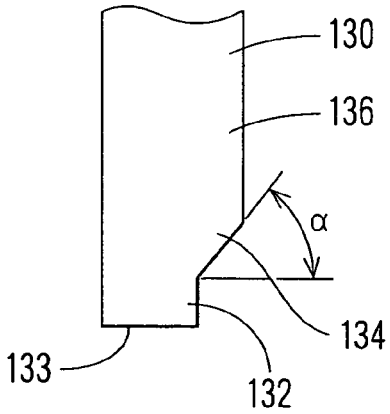
FIG. 8A is a schematic view showing a shape of the stationary core.
Figure 8B:
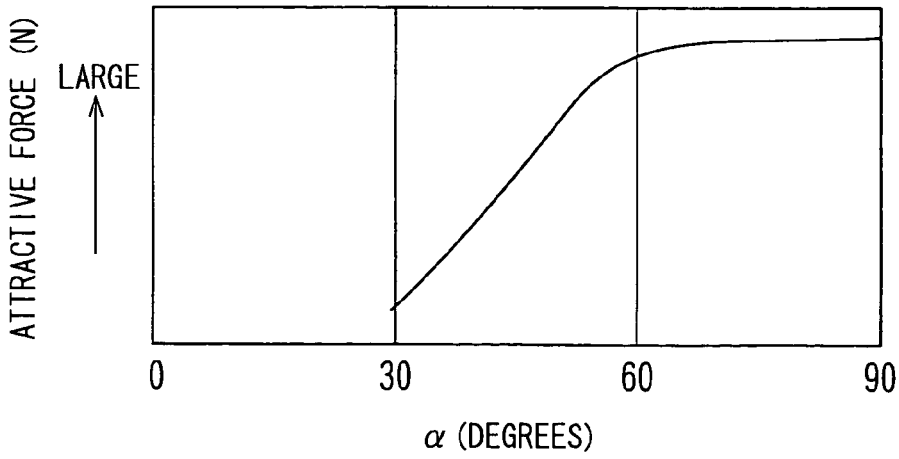
FIG. 8B is a characteristic diagram showing a relationship between a taper angle and a magnetic attractive force.
Figure 9:
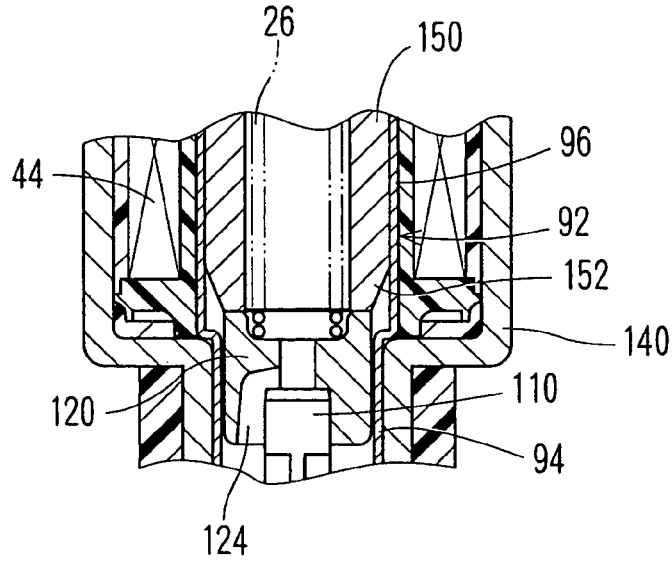
FIG. 9 is a cross sectional view showing opposed parts of a stationary core and of a movable core according to a fifth embodiment.
Figure 11:
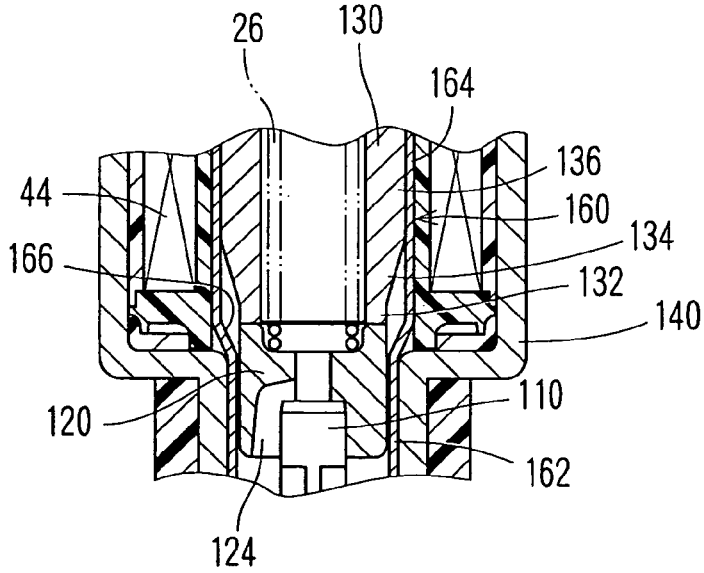
FIG. 11 is a cross sectional view showing opposed parts of a stationary core and of a movable core according to a sixth embodiment.

FIGS. 6 to 8 show a fourth embodiment of the present invention. FIG. 9 shows a fifth embodiment of the present invention. FIG. 11 shows a sixth embodiment of the present invention. Components similar to those of the first embodiment will be indicated by the same numerals.

In the fuel injection valve 90 of the fourth embodiment shown in FIG. 6, the tubular member is formed by a magnetic pipe 92, which is a single member made of a magnetic material. The magnetic pipe 92 has a generally uniform wall thickness and extends from the fuel inlet to an outer wall of a bottom of a valve body 100. The magnetic pipe 92 has a small diameter portion 94, an intermediate diameter portion 96 and a large diameter portion 98. The small diameter portion 94 covers an outer peripheral part of the valve body 100 and the outer peripheral part of the movable core 120. The intermediate diameter portion 96 covers the outer peripheral part of the stationary core 130. The large diameter portion 98 is located at the fuel inlet side of the magnetic pipe 92. The small diameter portion 94 serves as the magnetic member recited in the claims. The magnetic pipe 92 is stepped, and thus a step 95 is formed between the small diameter portion 94 and the intermediate diameter portion 96 in conformity with the outer diameter difference between the movable core 120 and the stationary core 130. In this way, the gap between the movable core 120 and the small diameter portion 94 is reduced.

The valve member 110 is joined with the movable core 120 and reciprocates together with the movable core 120. Four chamfered portions 112 are arranged one after another in the circumferential direction in a portion of the valve member 110, which slides relative to an inner peripheral surface of the valve body 100. Fuel flows between the chamfered portions 112 and the inner peripheral surface of the valve body 100. When the valve member 110 is lifted away from the valve body 100, fuel is injected through injection holes 102 provided in the bottom of the valve body 100. A communication passage 124 is formed in the connection between the movable core 120 and the valve member 110 to communicate with the stationary core 130 side. The spring 26, which urges the movable core 120 in the closing direction for closing the injection holes 102, is directly engaged with the stationary core 130.

As shown in FIG. 7, a surface area of the opposing end surface 133 of the stationary core 130, which is opposed to the movable core 120, is generally the same as that of the opposing end surface 122 of the movable core 120, which is opposed to the stationary core 130. The stationary core 130 has a straight portion 132, a tapered portion 134 and a large diameter portion 136 in this order from the opposing side end of the stationary core 130, which is opposed to the movable core 120. The cross sectional area of the magnetic path of the straight portion 132, which serves as the opposing portion and has an axial length L, is constant from the opposing end surface 133 side part of the straight portion 132 to the counter movable core side part of the straight portion 132. The outer diameter of the tapered portion 134 is increased from the straight portion 132 toward the large diameter portion 136. The cross sectional area of the magnetic path of the large diameter portion 136 is larger than the cross sectional area of the magnetic path of the opposing part of the movable core 120, which is opposed to the stationary core 130.

As shown in FIG. 6, the magnetic member 140 and the magnetic member 142 are magnetically connected to one another. The magnetic member 140 is magnetically connected to the small diameter portion 94 of the magnetic pipe 92, and the magnetic member 142 is magnetically connected to the intermediate diameter portion 96 of the magnetic pipe 92.

Next, a relationship between a taper angle $\alpha$ of the tapered portion 134 (FIG. 8A) and the magnetic attractive force will be described. As shown in FIG. 8B, when the taper angle $\alpha$ of the tapered portion 134 relative to the opposing end surface 1333 is increased, the magnetic attractive force is increased. When the taper angle $\alpha$ becomes equal to or greater than 60 degrees, the magnetic attractive force becomes generally constant. This is due to the fact that when the taper angle $\alpha$ become large, the outer peripheral surface of the opposing end surface 133 side part of the stationary core 130 does not rapidly approach the inner peripheral surface of the magnetic pipe 92, so that leakage of the magnetic flux from the opposing portion of the stationary core 130, which is opposed to the movable core 120, to the magnetic pipe 92 is reduced.

Furthermore, the straight portion 132, which is radially inwardly recessed relative to the large diameter portion 136, is provided in the opposing portion of the stationary core 130, which is opposed to the movable core 120. Therefore, a portion of the magnetic flux, which passes between the movable core 120 and the stationary core 130, is limited from flowing between the stationary core 130 and the small diameter portion 94, which covers the outer peripheral part of the movable core 120. Therefore, the magnetic attractive force is increased.

Figure 10:
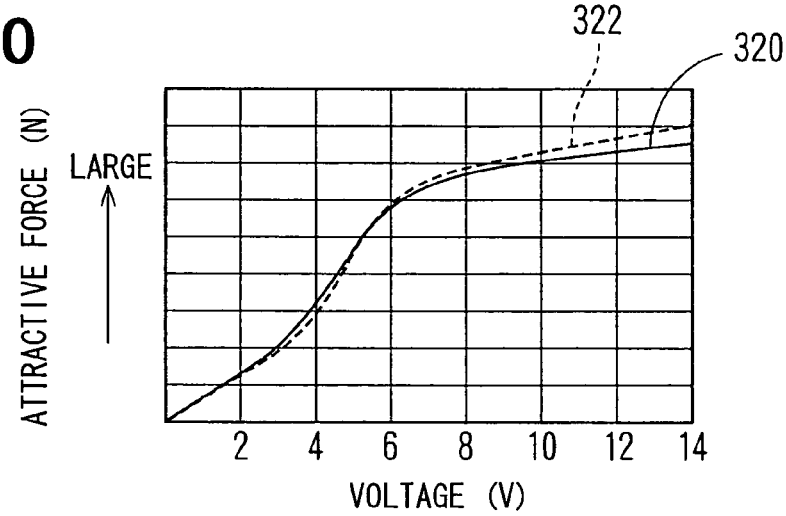
FIG. 10 is a characteristic diagram showing a relation ship between a voltage applied to a coil and a magnetic attractive force according to the fourth and fifth embodiments.

Furthermore, the straight portion 132, which is provided in the opposing portion of the stationary core 130 opposed to the movable core 120, acts as a magnetic choke. Therefore, the saturated attractive force can be reduced in comparison to the fifth embodiment shown in FIG. 9, in which the straight portion is not provided in the opposing portion of the stationary core 150, and only the tapered portion 152, which is tapered toward the movable core 120, acts as the magnetic choke. Therefore, the remaining magnetic flux is reduced, and thereby the valve closing response is improved. In FIG. 10, reference numeral 320 denotes a characteristic curve of the fourth embodiment, and reference numeral 322 denotes a characteristic curve of the fifth embodiment.

In the sixth embodiment shown in FIG. 11, a step 166, which is formed between the small diameter portion 162 and the intermediate diameter portion 164 of the magnetic pipe 160 that is the tubular member, is tapered. The magnetic pipe 160 is stepped because of the step 166. The structure other than this part is the same as that of the fourth embodiment.

(Seventh Embodiment)

Figure 12:
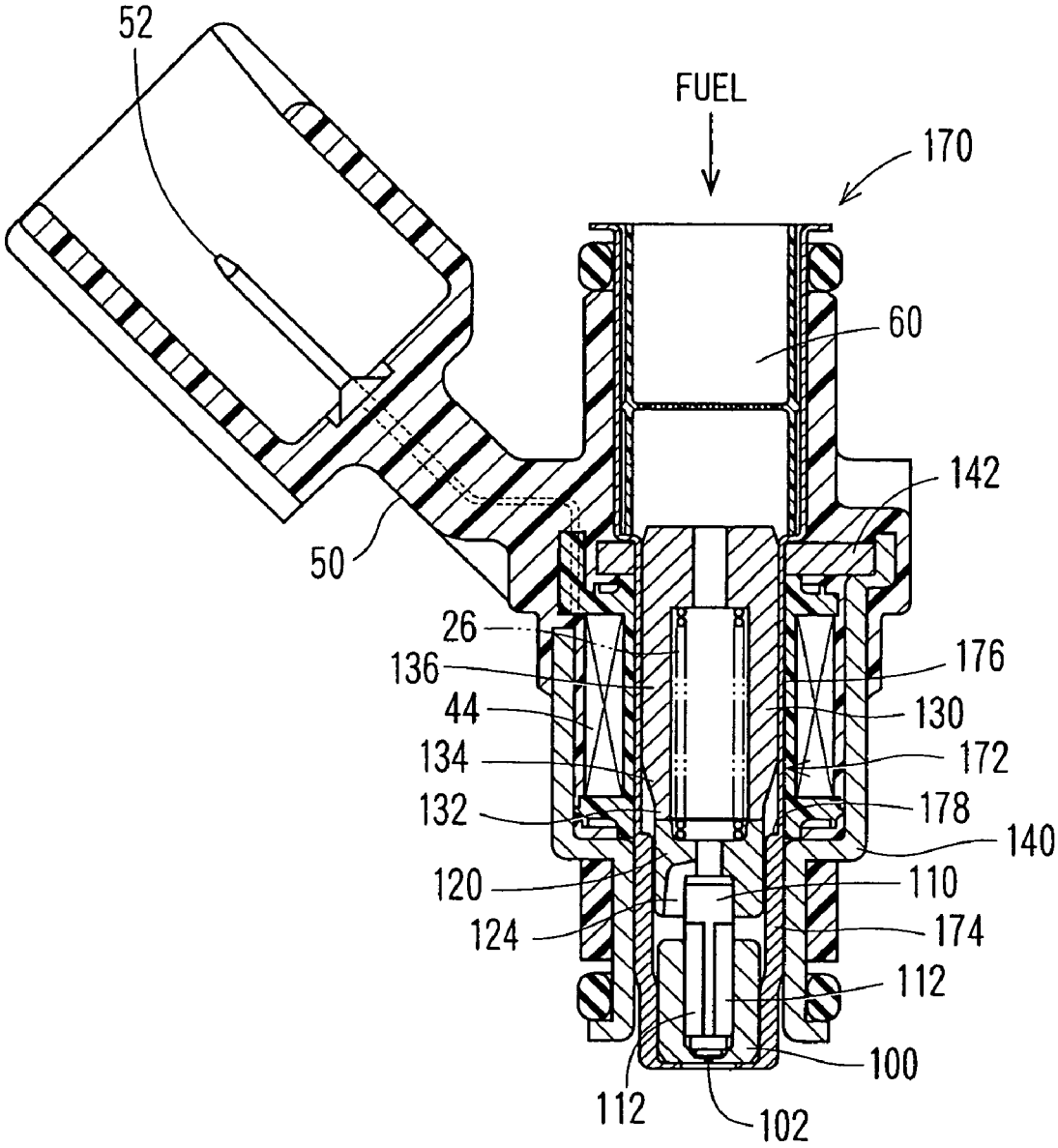
FIG. 12 is a cross sectional view showing a fuel injection valve according to a seventh embodiment.

FIG. 12 shows a seventh embodiment of the present invention. Components similar to those of the fourth embodiment will be indicated by the same numerals.

The tubular member 172 of the fuel injection valve 170 shown in FIG. 12 is made of the magnetic material and includes a thick wall portion 174 and a thin wall portion 176. The thick wall portion 174 covers the outer peripheral part of the valve body 100 and the outer peripheral part of the movable core 120. The thin wall portion 176 covers the outer peripheral part of the stationary core 130. The thick wall portion 174 serves as the magnetic member recited in the claims. A step 178 is formed between the thick wall portion 174 and the thin wall portion 176 due to the wall thickness difference between the thick wall portion 174 and the thin wall portion 176. The tubular member 172 is stepped due to the step 178, and a gap between the thick wall portion 174 and the movable core 120 is made small.

In the first to seventh embodiments, the large diameter portion, which has the outer diameter larger than that of the movable core, is formed in the counter movable core side part of the stationary core, and the cross sectional area of the magnetic path of the counter movable core side part of the stationary core is made larger than the cross sectional area of the magnetic path of the opposing part of the movable core, which is opposed to the stationary core. In this way, the magnetic attractive force for attracting the movable core is increased without increasing the weight of the movable core, so that the valve opening response is improved. Furthermore, the opposing portion of the stationary core, which is opposed to the movable core, is radially inwardly recessed, so that a portion of the magnetic flux, which passes between the stationary core and the movable core, is limited from flowing between the stationary core and the magnetic member, which is arranged radially outward of the movable core. Therefore, the magnetic attractive force for attracting the movable core to the stationary core is increased to improve the valve opening response.

Furthermore, the opposing end side part of the opposing portion of the stationary core, which is opposed to the movable core, is radially inwardly recessed, so that the cross sectional area of the magnetic path of the opposing end side part of the opposing portion of the stationary core is made smaller than the cross sectional area of the magnetic path of the large diameter portion. More specifically, the opposing portion of the stationary core serves as the magnetic choke. Thus, it is possible to limit the flow of the magnetic flux between the stationary core and the movable core beyond the required amount. Therefore, the saturated attractive force is reduced, and the remaining magnetic flux is reduced, so that the valve closing response is improved.

(Eighth Embodiment)

Figure 13:
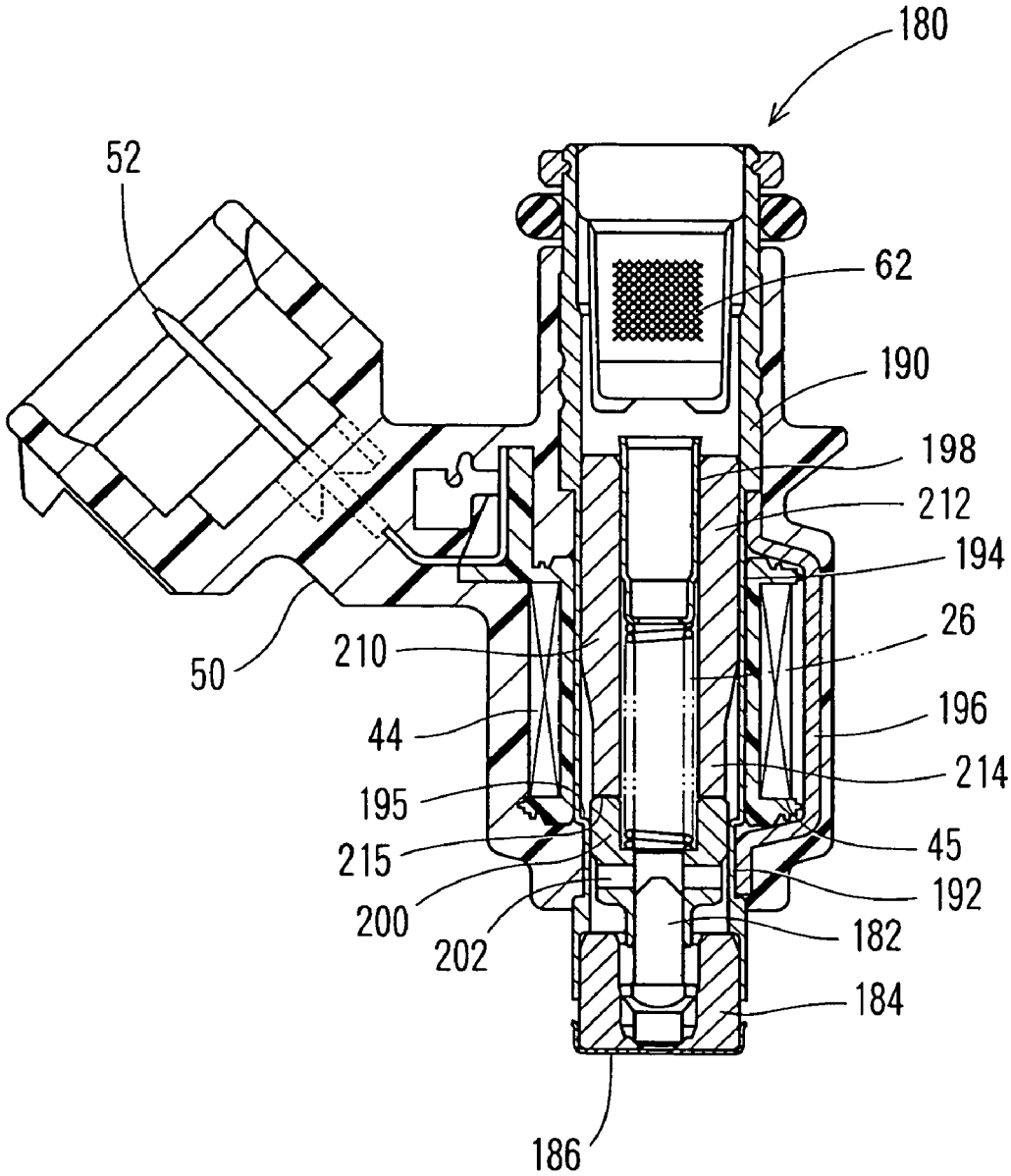
FIG. 13 is a cross sectional view showing a fuel injection valve according to an eighth embodiment.

FIG. 13 shows an eighth embodiment of the present invention. Components similar to those of the fourth embodiment will be indicated by the same numerals.

In the fuel injection valve 180 of the eighth embodiment, the valve body 184, the movable core 200 and the stationary core 210 are received in a non-magnetic pipe 190, which is s single member made of a non-magnetic material. The non-magnetic pipe 190 extends from the fuel inlet to a peripheral wall of the valve body 184. The non-magnetic pipe 190 has a small diameter portion 192 and a large diameter portion 194. The small diameter portion 192 covers an outer peripheral part of the valve body 184 and the outer peripheral part of the movable core 200. The large diameter portion 194 covers the outer peripheral part of the stationary core 210. The non-magnetic pipe 190 is stepped, and thus a step 195 is formed between the small diameter portion 192 and the large diameter portion 194 in conformity with the outer diameter difference between the movable core 200 and the stationary core 210. In this way, the gap between the movable core 200 and the magnetic member 196 is reduced by the non-magnetic pipe 190.

The valve member 182 of the fuel injection valve 180 is joined with the movable core 200 and reciprocates together with the movable core 200. A communication passage 202 is formed in the connection between the movable core 200 and the valve member 182 to communicate with the stationary core 210 side. The injection hole plate 186 is secured by, for example, welding to the outer wall of the bottom of the valve body 184. One end of the spring 26 is engaged with the adjusting pipe 198 and urges the movable core 200 in a closing direction for closing injection holes provided in the injection hole plate 186. The adjusting pipe 198 has a thin wall and is formed into the cylindrical shape.

The stationary core 210 includes a thick wall portion (large diameter portion) 212 and a thin wall portion (a tapered portion and a straight portion) 214. The thin wall portion 214 is provided in the opposing portion of the stationary core 210, which is closer to the movable core 200 in comparison to the thick wall portion 212. The outer peripheral surface of the thin wall portion 214 is radially inwardly recessed in comparison to the thick wall portion 212. The outer diameter of the thick wall portion 212 is larger than that of the movable core 200. The cross sectional area of the magnetic path of the thick wall portion 212 is larger than that of the movable core 200. The outer diameter of the thin wall portion 214 is generally the same as the outer diameter of the movable core 200. The cross sectional area of the magnetic path of the thin wall portion 214 is smaller than that of the thick wall portion 212.

A portion of the thick wall portion 212 is located radially inward of the coil 44. The position of the opposing surface 215 of the stationary core 210, which is opposed to the movable core 200, is generally the same as that of the movable core 200 side end portion 45 of the coil 44 or is closer to the movable core 200 in comparison to the end portion 45. Thus, the movable core 200 is axially outwardly displaced from the inner peripheral part of the coil 44 even in the state where the movable core 200 is attracted to the stationary core 210.

With this structure, the magnetic flux, which is generated from the coil 44 and includes its portion that does not contribute to the generation of the magnetic attractive force for attracting the movable core 200 toward the stationary core 210, flows more in the stationary core 210, which is axially overlapped with the coil 44, in comparison to the movable core 200. Furthermore, even in a case where a portion of the movable core 200 is placed radially inward of the coil 44, more magnetic flux flows in the stationary core 210 in comparison to the movable core 200 since the overlapping axial length of the stationary core 210, which overlaps with the coil 44 at radially inward of the coil 44, is larger than that of the movable core 200.

As described above, in the eighth embodiment, the thick wall portion 212, which has the larger cross sectional area of the magnetic path and has the greater amount of saturation magnetic flux in comparison to the movable core 200, is formed in the portion of the stationary core 210, which is located radially inward of the coil 44 and has the greater amount of magnetic flux in comparison to the movable core 200. Thus, the amount of magnetic flux, which flows between the movable core 200 and the stationary core 210 and contributes to the generation of the magnetic attractive force, is increased. Therefore, the magnetic attractive force for attracting the movable core 200 to the stationary core 210 is increased to improve the valve opening response.

Furthermore, in the eighth embodiment, the cross sectional area of the magnetic path of the thin wall portion 214 is smaller than the cross sectional area of the magnetic path of the thick wall portion 212. As a result, the thin wall portion 214 acts as a magnetic choke, so that it is possible to limit the flow of the magnetic flux between the movable core 200 and the stationary core 210 beyond the required amount, and it is possible to reduce the saturated attractive force. Therefore, the remaining magnetic flux is reduced, and thereby the valve closing response is improved.

(Ninth and Tenth Embodiments)

Figure 14:
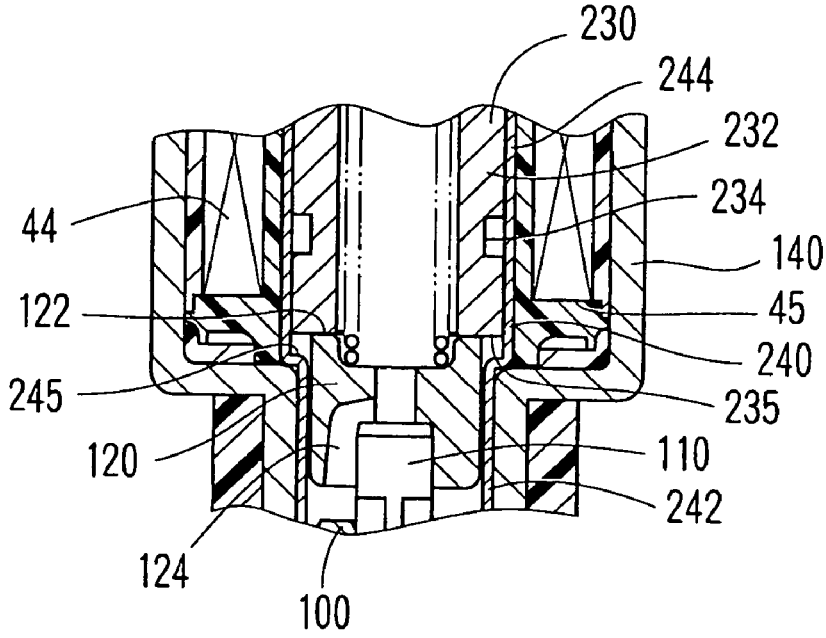
FIG. 14 is a cross sectional view showing opposed parts of a stationary core and of a movable core according to a ninth embodiment.
Figure 15:
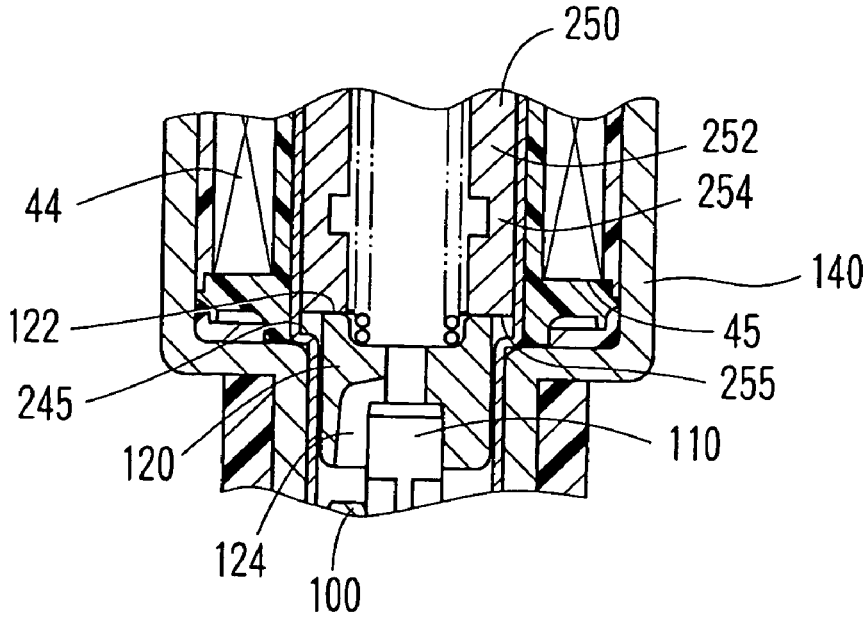
FIG. 15 is a cross sectional view showing opposed parts of a stationary core and of a movable core according to a tenth embodiment.
Figure 16:
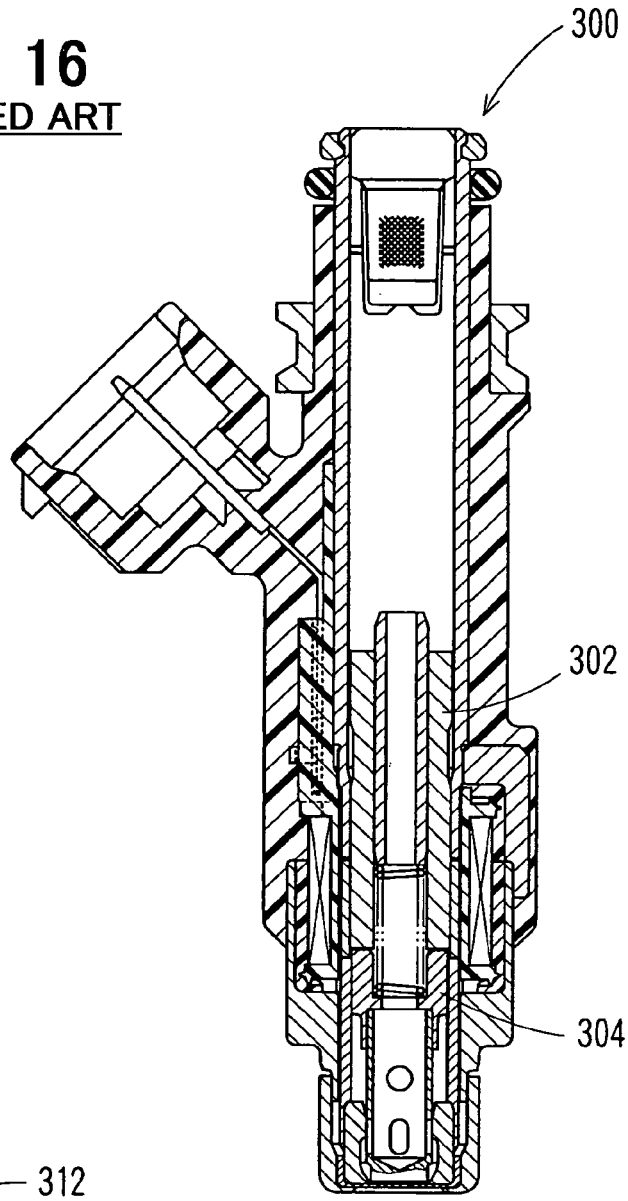
FIG. 16 RELATED ART
FIG. 16 is a cross sectional view showing a previously proposed fuel injection valve.
Figure 17:
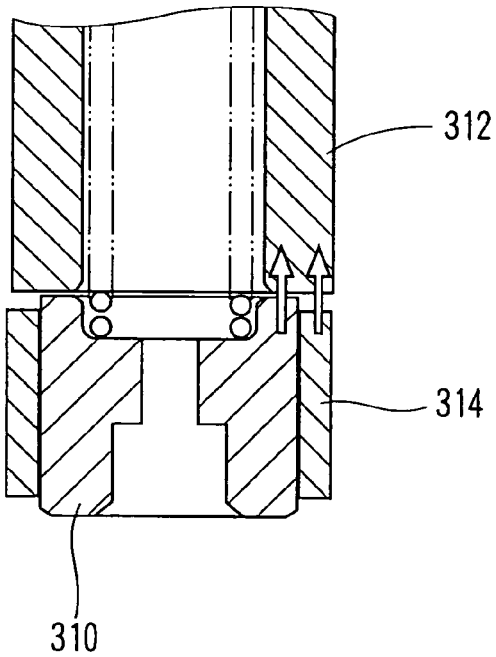
FIG. 17 RELATED ART
FIG. 17 is a cross sectional view opposed parts of a previously proposed stationary core and of a previously proposed movable core.

FIG. 14 shows a ninth embodiment of the present invention, and FIG. 15 shows a tenth embodiment of the present invention. Components similar to those of the fourth embodiment will be indicated by the same numerals.

In the ninth embodiment shown in FIG. 14, the thin wall portion 234 of the stationary core 230 is not formed in the opposing portion of the stationary core 230, which is opposed to the movable core 120. Rather, the thin wall portion 234 of the stationary core 230 is formed by radially inwardly recessing an outer peripheral surface of an intermediate portion of the stationary core 230 in comparison to the thick wall portion 232. Thus, in the ninth embodiment, the thick wall portion 232 is opposed to the movable core 120. The outer diameter of the thick wall portion 232 and the cross sectional area of the magnetic path of the thick wall portion 232 are larger than the outer diameter of the movable core 120 and the cross sectional area of the magnetic path of the movable core 120, respectively. The cross sectional area of the magnetic path of the thin wall portion 234 is smaller than that of the thick wall portion 232.

A portion of the thick wall portion 232 is located radially inward of the coil 44. The position of the opposing surface 235 of the stationary core 230, which is opposed to the movable core 120, is located closer to the movable core 120 in comparison to the movable core 120 side end 45 of the coil 44. Thus, the movable core 120 is axially outwardly displaced from the inner peripheral part of the coil 44 even in the state where the movable core 120 is attracted to the stationary core 230.

The magnetic pipe 240, which is the single member made of the magnetic material, receives the valve body 100, the movable core 120 and the stationary core 230. The magnetic pipe 240 has a small diameter portion 242 and a large diameter portion 244. The small diameter portion 242 covers an outer peripheral part of the valve body 100 and the outer peripheral part of the movable core 120. The large diameter portion 244 covers the outer peripheral part of the stationary core 230. The magnetic pipe 240 is stepped, and thus a step 245 is formed between the small diameter portion 242 and the large diameter portion 244 in conformity with the outer diameter difference between the movable core 120 and the stationary core 230. In this way, the gap between the movable core 120 and the small diameter portion 242 is reduced.

In the tenth embodiment shown in FIG. 15, the thin wall portion 254 of the stationary core 250 is not formed in the opposing portion of the stationary core 250, which is opposed to the movable core 120. Rather, the thin wall portion 254 of the stationary core 250 is formed by radially outwardly recessing an inner peripheral surface of an intermediate portion of the stationary core 250 in comparison to the thick wall portion 252. Thus, in the tenth embodiment, the thick wall portion 252 is opposed to the movable core 120. The outer diameter of the thick wall portion 252 and the cross sectional area of the magnetic path of the thick wall portion 252 are larger than the outer diameter of the movable core 120 and the cross sectional area of the magnetic path of the movable core 120, respectively. The cross sectional area of the magnetic path of the thin wall portion 254 is smaller than that of the thick wall portion 252.

A portion of the thick wall portion 252 is located radially inward of the coil 44. The position of the opposing surface 255 of the stationary core 250, which is opposed to the movable core 120, is located closer to the movable core 120 in comparison to the movable core 120 side end 45 of the coil 44. Thus, the movable core 120 is axially displaced from the inner peripheral part of the coil 44 even in the state where the movable core 120 is attracted to the stationary core 250.

As described above, even in the ninth and tenth embodiments, the thick wall portion 232, 252, which has the larger cross sectional area of the magnetic path and has the greater amount of saturation magnetic flux in comparison to the movable core 120, is formed in the portion of the stationary core 230, 250, which is located radially inward of the coil 44 and has the greater amount of magnetic flux in comparison to the movable core 120. Thus, the amount of magnetic flux, which flows between the movable core 120 and the stationary core 230, 250 and contributes to the generation of the magnetic attractive force, is increased. Therefore, the magnetic attractive force for attracting the movable core 120 to the stationary core 230, 250 is increased to improve the valve opening response.

Furthermore, in the ninth and tenth embodiments, the cross sectional area of the magnetic path of the thin wall portion 234, 254 is smaller than the cross sectional area of the magnetic path of the thick wall portion 232, 252. As a result, the thin wall portion 234, 254 acts as a magnetic choke, so that it is possible to limit the flow of the magnetic flux between the movable core 120 and the stationary core 230, 250 beyond the required amount, and it is possible to reduce the saturated attractive force. Therefore, the remaining magnetic flux is reduced, and thereby the valve closing response is improved.

In the ninth embodiment, the outer peripheral surface is radially inwardly recessed to form the thin wall portion 234. Thus, the thin wall portion can be easily formed in comparison to a case where the inner peripheral surface is radially outwardly recessed.

(Other Embodiment)

In the fourth to sixth embodiments, the magnetic pipe (the tubular member) is the single member made of the magnetic material. However, the magnetic pipe may be made of a plurality of magnetic members.

Furthermore, in the fourth embodiment, the tapered portion 134 is formed between the straight portion 132, which is formed in the opposing portion of the stationary core 130 that is opposed to the movable core 120, and the large diameter portion 136, which has the cross sectional area of the magnetic path greater than that of the opposing part of the movable core 120 that is opposed to the stationary core 130.

In the ninth and tenth embodiments, the outer peripheral part of the movable core and the outer peripheral part of the stationary core are covered by the magnetic pipe 240. Alternatively, the outer peripheral part of the movable core and the outer peripheral part of the stationary core may be covered by a non-magnetic pipe.

In the first embodiment, the non-magnetic member 16 is provided in the tubular member 12 by welding the non-magnetic member 16 between the magnetic members 14, 18. Alternatively, the non-magnetic member 16 may be provided in a single magnetic tubular member by demagnetization of a corresponding part of the tubular member through, for example, heating of the corresponding part of the tubular member.

It should be noted that the tapered portions 32, 72, 134, 152 and the straight portion 132 of the stationary cores of the first to seventh embodiments may serve as thin wall portions of the stationary cores. Also, the large diameter portions 34, 74, 136 of the stationary cores of the first to seventh embodiments may serve as thick wall portions of the stationary cores.

Additional advantages and modifications will readily occur to those skilled in the art. The invention in its broader terms is therefore not limited to the specific details, representative apparatus, and illustrative examples shown and described. Also, any component(s) of any one of the above embodiments can be combined with or replaced with any other component(s) of any other embodiments.

What is claimed is:

1. A fuel injection valve comprising:

a stationary core;

a movable core that is opposed to the stationary core;

a valve member that is reciprocated together with the movable core to enable and disable injection of fuel from the fuel injection valve;

a coil that generates a magnetic attractive force between the stationary core and the movable core upon energization of the coil; and a tubular member, which is formed integrally and is arranged radially inward of the coil, wherein:

the tubular member covers an outer peripheral part of the stationary core and an outer peripheral part of the movable core to form a magnetic circuit in cooperation with the stationary core and the movable core and includes a magnetic member that is arranged radially outward of the movable core;

an inner diameter of the tubular member decreases from a stationary core side of the tubular member, which engages the stationary core, to a movable core side of the tubular member, which is slidably engageable with the movable core;

an amount of change in the inner diameter of the tubular member between the stationary core side and the movable core side of the tubular member is equal to or larger than a peripheral wall thickness of the tubular member;

the stationary core includes:

an opposing portion that is opposed to the movable core; and a large diameter portion that is arranged on a counter movable core side of the opposing portion, which is opposite from the movable core;

an outer diameter of the large diameter portion is larger than an outer diameter of the movable core;

a cross sectional area of a magnetic path of the large diameter portion is larger than that of an opposing part of the movable core, which is opposed to the stationary core; and an opposing end surface side part of the opposing portion, which is opposed to the movable core, is radially inwardly recessed relative to the large diameter portion.

2. The fuel injection valve according to claim 1, wherein an outer diameter of an opposing end surface of the opposing portion, which is opposed to the movable core, is generally the same as the outer diameter of the movable core.

3. The fuel injection valve according to claim 1, wherein the opposing portion has a slant surface, which has an increasing diameter that is increased from the opposing end surface side part toward the counter movable core side part of the opposing portion, which is opposite from the movable core.

4. The fuel injection valve according to claim 1, wherein the opposing portion is a straight portion, in which a cross sectional area of the magnetic path is constant in an axial direction.

5. The fuel injection valve according to claim 1, wherein:

the opposing portion is a straight portion, in which a cross sectional area of the magnetic path is constant in an axial direction;

the stationary core includes a tapered portion between the straight portion and the large diameter portion; and the tapered portion has an increasing outer diameter that increases from the straight portion toward the large diameter portion.

6. The fuel injection valve according to claim 1, wherein the tubular member is a magnetic pipe, which is formed integrally from a magnetic material.

7. The fuel injection valve according to claim 1, wherein:

the magnetic member is a first magnetic member;

the tubular member further includes a second magnetic member and a non-magnetic member; and the non-magnetic member is held between the first magnetic member and the second magnetic member.

8. The fuel injection valve according to claim 1, wherein the magnetic member extends along an entire length of the tubular member.

9. The fuel injection valve according to claim 1, wherein the stationary core has an asymmetrical profile, which is asymmetrical with respect to an imaginary plane that extends through a longitudinal center of the stationary core in a direction perpendicular to a longitudinal axis of the stationary core.

10. The fuel injection valve according to claim 1, wherein an outer diameter of an opposing end surface of the opposing portion of the stationary core is larger than an outer diameter of an opposing end surface of the movable core, which is opposed to the opposing end surface of the opposing portion of the stationary core.

11. The fuel injection valve according to claim 1, wherein:

the stationary core further includes a tapered portion between the large diameter portion and the opposing end surface side part of the opposing portion; and a taper angle of the tapered portion is equal to or greater than 60 degrees.

* * * * *